United States Patent [19]

Hattori et al.

[11] 4,215,158

[45] Jul. 29, 1980

[54] MAGNETIC RECORDING MEDIUM AND PROCESS FOR PRODUCING THE SAME

[75] Inventors: Seizi Hattori, Nishiibaragi; Takehiko Nakagawa, Kawasaki; Kazuo Kobayashi, Koza; Koichi Makino, Yokohama; Wakatake Matsuda, Zama, all of Japan

[73] Assignees: Fujitsu Limited; Nippon Telegraph and Telephone Public Corporation, both of Japan

[21] Appl. No.: 776,591

[22] Filed: Mar. 2, 1977

[30] Foreign Application Priority Data

Mar. 3, 1976 [JP] Japan ..... 51-22209

[51] Int. Cl.[2] ..... H01F 1/10

[52] U.S. Cl. ..... 427/130; 204/192 R; 204/192 C; 204/192 M; 252/62.56; 252/62.57; 252/62.58; 252/62.59; 252/62.6; 427/255.4; 428/900

[58] Field of Search ..... 156/605, 606; 428/900, 428/539, 336, 220; 204/192 R, 192 C, 192 M; 252/62.56, 62.57, 62.58, 62.59, 62.6; 365/32; 340/134, 135; 427/127, 128, 130, 248

[56] References Cited

U.S. PATENT DOCUMENTS

| | | | |
|---|---|---|---|
| 3,414,372 | 12/1968 | Panlers et al. | 156/605 |
| 3,995,093 | 11/1976 | Heinz | 428/900 |
| 3,996,095 | 12/1976 | Ahor et al. | 204/192 M |
| 4,003,813 | 1/1977 | Hattori et al. | 204/192 M |
| 4,013,534 | 3/1977 | Ishii | 360/135 |

FOREIGN PATENT DOCUMENTS

| | | | |
|---|---|---|---|
| 5175503 | of 1974 | Japan | 428/900 |

*Primary Examiner*—Stanley S. Silverman
*Attorney, Agent, or Firm*—Staas & Halsey

[57] ABSTRACT

A thin film of ferrite for use as a magnetic recording medium includes up to ten atomic percent of Nb based on the total number of metallic atoms in the ferrite film. This thin film of ferrite further includes up to fifteen atomic percent of Cu in addition to the Nb. The inclusion of Nb improves the squareness ratio and the coercive force of the recording medium, and also enlarges the temperature range of reduction from $\alpha$ -$Fe_2O_3$ to one of the ferrites, i.e. $Fe_3O_4$. The inclusion of Cu lowers the reduction temperature below 300° C. According to the invention, a magnetic recording medium exhibiting excellent required properties, such as a high coercive force and a high squareness ratio, can be produced by a reliable process.

13 Claims, 8 Drawing Figures

MAGNETIC RECORDING MEDIUM AND PROCESS FOR PRODUCING THE SAME

BACKGROUND OF THE INVENTION

The invention is directed to a magnetic recording medium, and particularly to a magnetic recording medium using a thin film of ferrite as well as to a process for producing the same.

DESCRIPTION OF THE PRIOR ART

It is generally known that as a recording medium, in addition to the above-mentioned thin films of ferrite, a coating film of acicular, crystalline particles of $\gamma$-$Fe_2O_3$ and an electrolytically deposited film of an Ni-Co alloy can also each be used.

The coating film is polished in order to make the film thinner and to increase the recording density of the produced recording medium. However, it is considered quite difficult to further increase the recording density, becaus of the difficulty in making the film thinner by polishing and because of the fact that the $\gamma$-$Fe_2O_3$ crystals are dispersed in their binder.

The magnetic recording medium of the Ni-Co alloy can be easily provided in the form of a thin film. However, this alloy is corrosive and exhibits poor wear resistance. Therefore, it is necessary to apply a protective film with a thickness of about 0.2 microns on the Ni-Co alloy, with the result being that the distance between a magnetic head and the recording medium is increased according to the added thickness of the protective film. Because of the increased distance between the magnetic head and the recording medium, the area for memorizing a unit of information is widened, thereby making it difficult to perform a highly densified recording.

The known thin film of ferrite is free from the above-described disadvantages, and is far superior in corrosion resistance and wear resistance than either the coating film or the electrolytically deposited film.

One of the problems residing in the known films of ferrite used as a recording medium is that their magnetic properties are lower than the desirable properties for a highly densified recording medium, i.e. properties exhibiting a coercive force (Hc) of from 400 to 500 Oe and a squareness ratio (Br/Bs) of 0.5 or more. The typical coercive force and the squareness ratio of the known ferrites are 300 Oe and 0.4 respectively, with regard to $Fe_3O_4$, and 300 Oe and 0.4, respectively, with regard to $\gamma$-$Fe_2O_3$.

The term thin film of ferrite herein used indicates a continuous film of the iron oxides of $Fe_3O_4$ or $\gamma$-$Fe_2O_3$, which oxides are crystallized directly on a substrate for supporting the recording medium such as a disc, so that the crystals remain in a continuous state on the substrate, i.e. the crystals are not separated by a binder. The film of ferrite is generally produced by the following steps.

An $\alpha$-$Fe_2O_3$ is continuously formed by using any of the procedures such as reaction sputtering, i.e. chemical sputtering, the coprecipitation method, the vapor growth method and the like. The $\alpha$-$Fe_2O_3$ is then reduced to $Fe_3O_4$, which is oxidized, if desired, to $\gamma$-$Fe_2O_3$. The $\alpha$-$Fe_2O_3$ can also be formed from $Fe(OH)_3$ or $(FeOH)_2$, which is precipitated on the substrate.

Another of the problems is that it is difficult to stably reduce $\alpha$-$Fe_2O_3$ to $Fe_3O_4$, due to the narrow temperature range for the reduction. This reduction step is the most difficult of all the steps for producing the ferrite, and it is likely to cause an excessive reduction of $\alpha$-$Fe_2O_3$ into a metallic iron.

Another of the problems is that the reduction temperature is approximately as high as 300° C., with the result that the anodized aluminum is difficult to employ as the substrate for the magnetic recording medium.

SUMMARY OF THE INVENTION

An object of the present invention is a magnetic recording medium of ferrite exhibiting improved magnetic properties.

It is another object of the present invention to provide a process for producing a magnetic recording medium of ferrite, wherein the temperature range for the reduction of $\alpha$-$Fe_2O_3$ to $Fe_3O_4$ is widened.

It is a further object of the present invention to lower the temperature of reduction from $\alpha$-$Fe_2O_3$ to $Fe_3O_4$, thereby performing the reduction below 300° C.

In accordance with the present invention, there is provided a magnetic recording medium of a thin film of ferrite, characterized in that the ferrite comprises a main component of $Fe_3O_4$ and an additional component of niobium of between 0.1 to 10 percent of the total number of metallic atoms in the ferrite film.

In accordance with the present invention, there is also provided a magnetic recording medium of a thin film of ferrite characterized in that the ferrite comprises a main component of $\gamma$-$Fe_2O_3$ and an additional component of niobium up to ten atomic percent of the total number of metallic atoms in the ferrite film.

In accordance with the present invention, there is further provided a magnetic recording medium of a thin film of ferrite, characterized in that the ferrite comprises a main component of $Fe_3O_4$ and additional components of niobium of between 0.1 to 10 percent and copper of between one and fifteen percent of the total number of metallic atoms in the ferrite film.

In accordance with the present invention, there is also provided a magnetic recording medium consisting of a thin film of ferrite, characterized in that the ferrite comprises a main component of $\gamma$-$Fe_2O_3$ and additional components of niobium of between one to ten percent and of copper between one and fifteen percent based on the total number of metallic atoms in the ferrite film.

The percentages of Nb and Cu in the ferrite, hereinafter used, are based on the total number of metallic atoms, in the ferrite film. In other words, the oxygen atoms, also contained in the ferrite film are not recognized for the calculation of the Nb and Cu contents.

The niobium and copper are believed to be present in the crystals of the iron oxides as either metallic ions in the state of a solid solution or as crystals of oxides in the state of mixed crystals with the iron oxides depending upon the contents of niobium and copper.

The thin film of ferrite according to the present invention generally has a thickness of 0.05 to 1 micron, preferably 0.05 to 0.4 micron.

The magnetic recording device is generally produced by applying the recording medium of the invention on a substrate in the form of a disc or tape. Furthermore, this device possesses a recording density of from 470 to 1000 bits per mm.

A process according to the present invention is characterized in that the $\alpha$-$Fe_2O_3$, which can be produced by any of the known methods, includes niobium in an amount from 0.1 to 10 percent of the total number of iron and niobium atoms. In addition, the reduction step of the $\alpha$-$Fe_2O_3$ to $Fe_3O_4$ is performed by heating the $\alpha$-$Fe_2O_3$ containing niobium at a temperature of from 325° to 400° C. under an atmosphere which contains a hydrogen gas.

Another process according to the present invention is characterized in that the $\alpha$-$Fe_2O_3$, which can be produced by any of the known methods, includes niobium in an amount of between 0.1 and 10 percent and copper in an amount of between one and fifteen percent of the total number of iron, copper and niobium atoms in the ferrite film. In addition, the reduction step of the $\alpha$-$Fe_2O_3$ to $Fe_3O_4$ is performed by heating the $\alpha$-$Fe_2O_3$ containing niobium at a temperature of from 225° to 400° C., preferably from 225° to below 300° C., under an atmosphere which contains a hydrogen gas.

It is preferable to form the $\alpha$-$Fe_2O_3$ film on an anodic oxidized Al by chemical sputtering and then to reduce the $\alpha$-$Fe_2O_3$ film by a hydrogen gas, which is saturated with water vapor due to bubbling the hydrogen gas through the water. This is because the thus produced films of $\gamma$-$Fe_2O_3$ exhibit excellent adhesion to the substrate, wear resistance and precision of the surface of the substrate. The reduction temperature below 300° C. is advantageous from the point of view of preventing the distortion and cracking of Al disc. This Al is liable to be distorted or cracked due to the difference in the thermal expansion coefficients between the different materials, i.e. Al and the iron oxide, when the reduction temperature is high.

Still another process according to the present invention is characterized in that the $Fe_3O_4$, which is produced by the above processes according to the invention and contains Nb or both Nb and Cu, is oxidized at a temperature from 150° to 450° C. in an atmosphere which contains oxygen.

BRIEF DESCRIPTION OF THE DRAWINGS

The invention is further illustrated with reference to FIGS. 1 through 8, wherein

In FIGS. 3, 4 and 5 are indicated the respective maximum and minimum values of the property being depicted.

DETAILED DESCRIPTION OF THE INVENTION

The $Fe_3O_4$ film which contains Nb according to the present invention is characterized by the fact that the $Fe_3O_4$ is produced by reduction from $\alpha$-$Fe_2O_3$ to $Fe_3O_4$, wherein the difference in the range of the reduction temperature for $Fe_2O_3$ with Nb is increased by twice as much as that of the $\alpha$-$Fe_2O_3$ without Nb.

The thin films of $Fe_3O_4$ with or without the addition of Nb were produced by a process which relied on the preferable procedures of chemical sputtering and reduction.

The sputtering was performed in an atmosphere comprising 80% of Ar and 20% of $O_2$. The iron was used as a target of sputtering, the thin films of $\alpha$-$Fe_2O_3$ free of Nb were formed on an Al substrate up to a thickness of 1 micron or less.

The ferrites which contained Nb were produced in the above-mentioned atmosphere by using an iron target containing 5% by weight of Nb. As a result, $\alpha$-$Fe_2O_3$ films containing 5% of Nb were formed on the Al substrate up to a thickness of 1 micron or less.

Both the $\alpha$-$Fe_2O_3$ film and the $\alpha$-$Fe_2O_3$ film containing Nb were heated at several distinct temperature levels up to 400° C. over a period of one hour under a hydrogen atmosphere. While the films were being heated, the films were subjected to a measurement of the electric resistance thereof by a method referred to as the four-probe method which is illustrated in FIG. 1.

Figure 1:
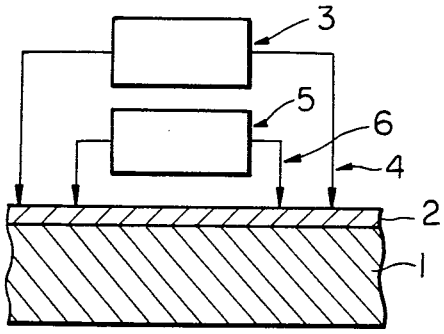
FIG. 1 is a schematic drawing showing a method for measuring the electrical resistance of a thin film.

In FIG. 1, a constant current source 3 was contacted with parts of a film 2 deposited on a substrate 1, in such a manner that probes 4 of the current source 3 were brought into a point of contact with the surface of the film 2 at a distance of 0.25 mm between the probes 4. The probes 4 consisted of a tungsten wire and were pressed against the film 2 by a spring force. A voltage meter 5 measuring the voltage of the order of microvolts was similarly contacted with the film 2 through probes 6 thereof, so as to locate these probes 6 within the probes 4. The resistance value of the film 2 could, therefore, be determined by comparing a given value of current with the measured voltage.

In addition to the measurement of resistance, a measurement of saturation magnetization and X-ray diffractography were performed to investigate the degree of reduction in the thin films.

Figure 2:
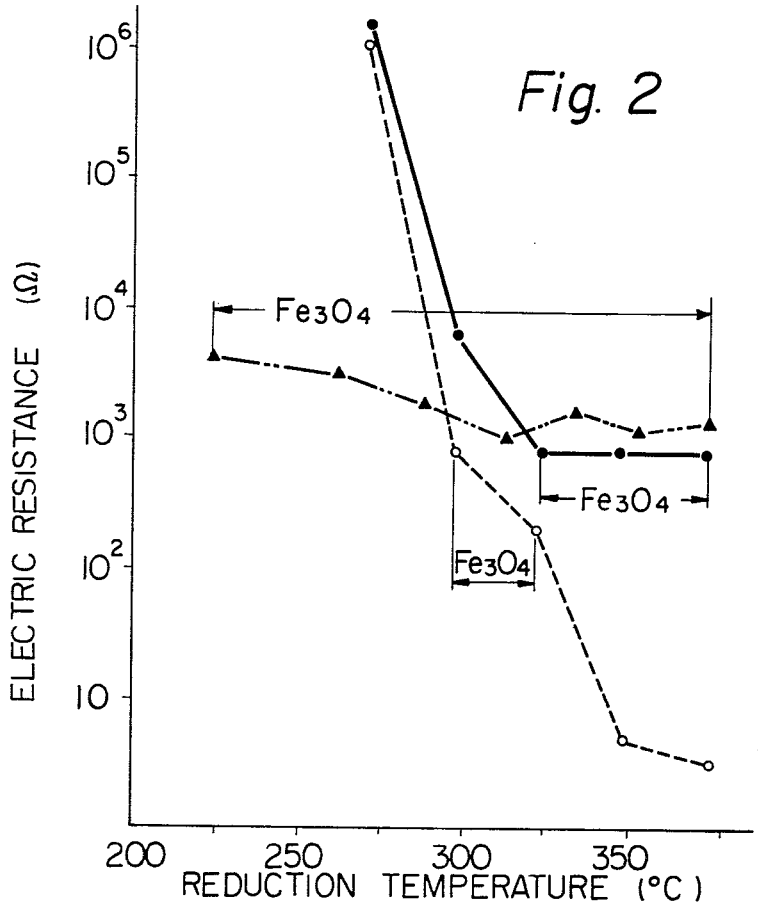
FIG. 2 is a graph representing the dependence of an electrical resistance of the film upon the reduction temperature.

The relationship between the electric resistance and the reduction temperature is illustrated in FIG. 2, in which the —·— curve and the —o— curve indicate, iron oxide films which contain Nb and iron oxide films which do not contain Nb, respectively.

According to the measurement of saturation magnetization and X-ray diffractography, it was found that $\alpha$-$Fe_2O_3$ remained unreduced when the resistance value exceeded $10^3\Omega$, while the $\alpha$-$Fe_2O_3$ was reduced to $Fe_3O_4$ at a resistance value ranging from $10^2$ to $10^3\Omega$. The $\alpha$-$Fe_2O_3$ was, however, excessively reduced to Fe, when the resistance value was decreased to $10^2\Omega$ or less.

The films of $\alpha$-$Fe_2O_3$ containing both 5% of Nb and 5% of Cu were produced by a procedure similar to that of production of the $\alpha$-$Fe_2O_3$ containing only Nb, and were subjected to measurement of electric resistance. The results are illustrated in FIG. 2 by the line —▲—.

The following facts will be apparent from FIG. 2.

(1) The $\alpha$-$Fe_2O_3$ containing five percent of Nb can be reduced to $Fe_3O_4$ within a temperature range of from 325° to 400° C.

(2) The reduction temperature range of $\alpha$-$Fe_2O_3$ without Nb is from 300° to 325° C.

(3) The reduction temperature range for the $\alpha$-$Fe_2O_3$ with Nb is increased by twice as much as that of the $\alpha$-$Fe_2O_3$ without Nb.

(4) The $\alpha$-$Fe_2O_3$ containing 5% of Cu and 5% of Nb can be reduced to $Fe_3O_4$ within a temperature range from 225° to 400° C.

(5) The reduction temperature range for the $\alpha$-$Fe_2O_3$ containing both Nb and Cu is much larger than for the addition of only Nb.

(6) The reduction temperature for the $\alpha$-$Fe_2O_3$ with Nb and Cu is lower than that for the $\alpha$-$Fe_2O_3$ containing no additional element, and can be from 225° to below approximately 300° C., which is seen from FIG. 2 to be the lower limit of the range for reduction of $\alpha$-$Fe_2O_3$ with no additional component.

It is also to be noted that the resistance value of the $Fe_3O_4$ containing Nb or both Nb and Cu is almost constant at approximately $10^3\Omega$ within the range of the reduction temperature. It is therefore possible, according to the present invention, to stably produce $Fe_3O_4$ films without any danger of excessively reducing the $\alpha$-$Fe_2O_3$ to metallic Fe.

The above illustrated advantageous effects of Nb and Cu were proved to be not dependent upon the Nb content between one and 10 percent and the Cu content between one and fifteen percent, respectively.

The ferrite film with Nb according to the present invention contains preferably from 0.1 to 10% of Nb, and more preferably from 5 to 10% of Nb. The temperature for reducing $\alpha$-$Fe_2O_3$ to $Fe_3O_4$ is not dependent on the Nb content, when the Nb content ranges from one to ten percent.

$Fe_3O_4$ films containing up to fifteen percent of Nb were produced by a method employing chemical sputtering and reduction of $\alpha$-$Fe_2O_3$ to $Fe_3O_4$ in $H_2$ gas. Subsequently, the produced $Fe_3O_4$ films were subjected to a measurement of the magnetic flux density.

Figure 3:
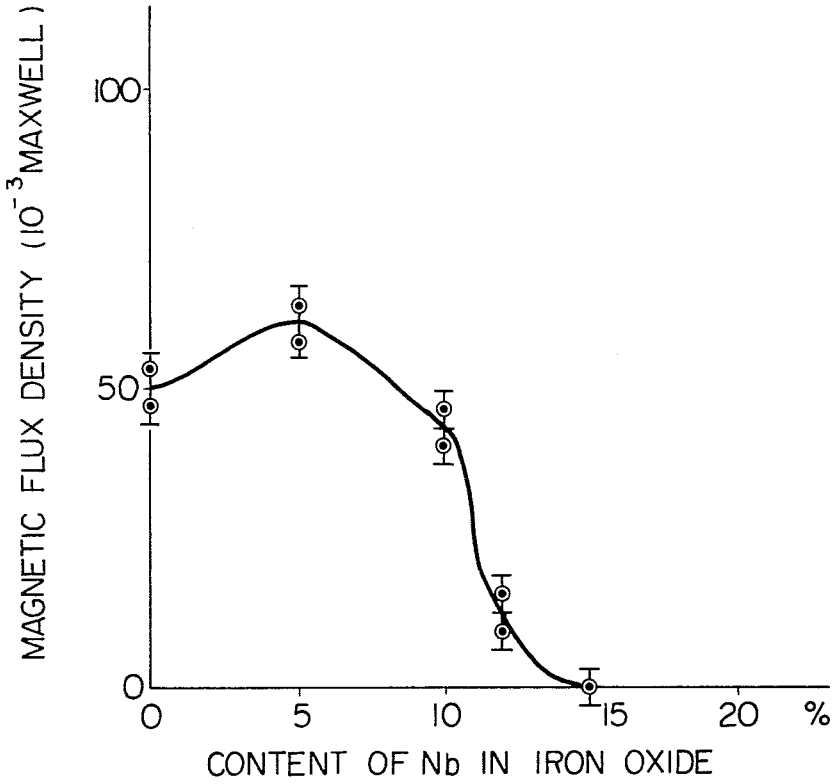
FIG. 3 is a graph representing the dependence of magnetic flux density upon the amount of Nb added into the iron oxide.

The relationship between the magnetic flux density and the Nb content is illustrated in FIG. 3.

As is clear from FIG. 3, the magnetic flux density decreases sharply with an increase in the Nb content of from 10 to 15%. The magnetic material containing Nb is changed to a nonmagnetic oxide when the content of Nb is fifteen percent. When the Nb content does not exceed 10%, the magnetic flux density is satisfactorily high, no matter which crystallographic form of Nb may be present in the crystal of the iron oxides.

The $Fe_3O_4$ films containing 0, 5 and 10 percent of Nb were produced by the same method as that of the $Fe_3O_4$ with up to fifteen percent of Nb. The produced films were subjected to a measurement of the coercive force and of the squareness ratio.

Figure 4:
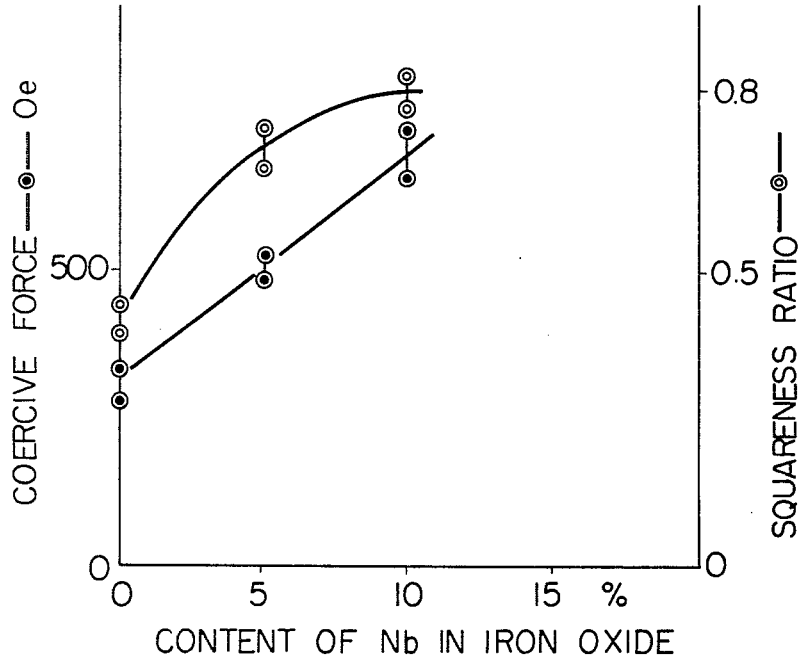
FIG. 4 is a graph representing the dependence of both the coercive force and the squareness ratio upon the amount of Nb added into the iron oxide.

The relationships between the coercive force and the Nb content, as well as between the squareness ratio and the Nb content, are illustrated in FIG. 4.

As is clear from this figure, the coercive force represented by the curve —⊙— and the squareness ratio represented by the curve —⊙—, are proportional to the Nb content of the ferrite. The Nb content of ferrite should be approximately 0.1% or more from the viewpoint of achieving a high squareness ratio of more than 0.5, and should be 5% or more from the viewpoint of achieving both a high, squareness ratio of more than 0.75 and a coercive force of more than 500 Oe.

In addition to providing a thin film of $Fe_3O_4$ with improved magnetic recording properties, the present invention also provides a thin film of $\gamma$-$Fe_2O_3$ having an improved squareness ratio and improved characteristics of adhesion to the recording substrate.

The Nb content in the $\gamma$-$Fe_2O_3$ should preferably be from 0.1 to 10%, and more preferably from 5 to 10%.

The $Fe_3O_4$ films containing 5% of Nb and produced by the above-mentioned process were further subjected to oxidation of the $Fe_3O_4$ to $\gamma$-$Fe_2O_3$ under known condition, i.e. heating the $Fe_3O_4$ at a temperature of from 150° to 400° C. in air. The thus treated films were subjected to a measurement of the coercive force and the squareness ratio.

Figure 5:
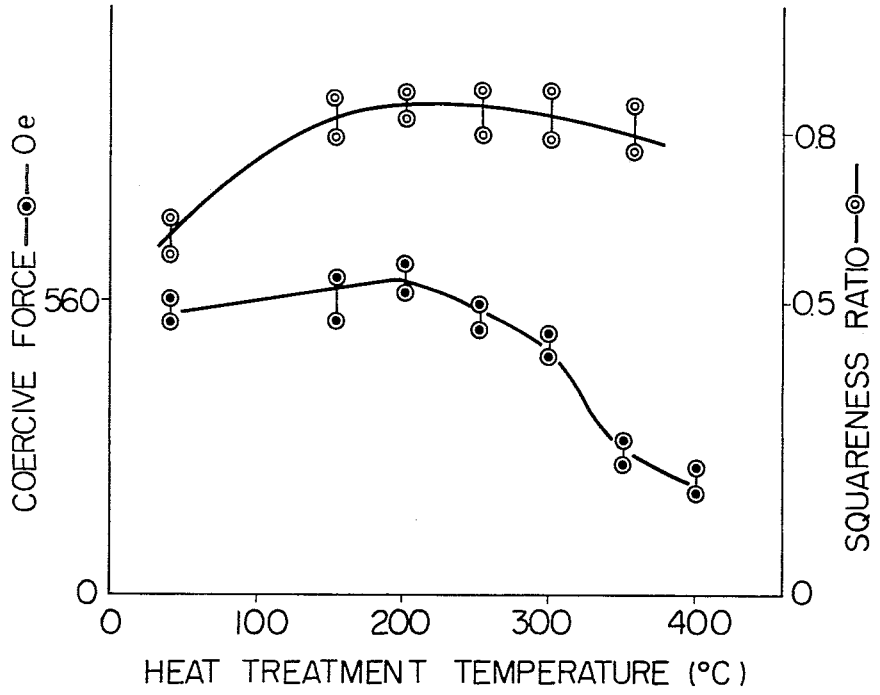
FIG. 5 is a graph representing the dependence of both the coercive force and the squareness ratio upon the heat treatment temperature in air.

The relationship between the squareness ratio and the heat treatment temperature and the relationship between the coercive force and the heat treatment temperature are illustrated in FIG. 5.

As is clear from FIG. 5, a coercive force of 500 Oe or more and a squareness ratio of 0.8 or more can be provided, when the $\gamma$-$Fe_2O_3$ is formed by a reduction process at a temperature of from 150° to 250° C.

The ferrite films containing both Cu and Nb should contain Nb in an amount not exceeding 10%, preferably between 1 and 9%, and also should contain Cu in an amount not exceeding 15%, preferably from 1 to 9%. When the Nb content exceeds 10%, the oxides of niobium are incorporated in the films of ferrite and reduce the saturation magnetization of the films. When the Cu content exceeds 15%, the squareness ratio and the saturation magnetization is decreased, so that the films of ferrite are no longer suitable as a recording medium of high density.

$Fe_3O_4$ films containing five percent of Nb and five percent of Cu, the $Fe_3O_4$ films containing ten percent each of both Nb and Cu, and $Fe_3O_4$ films containing either Nb nor Cu were formed on a glass substrate and then oxidized in air up to 450° C. Subsequently, the produced $Fe_3O_4$ films were subjected to measurement of coercive force and squareness ratio.

Figure 6:
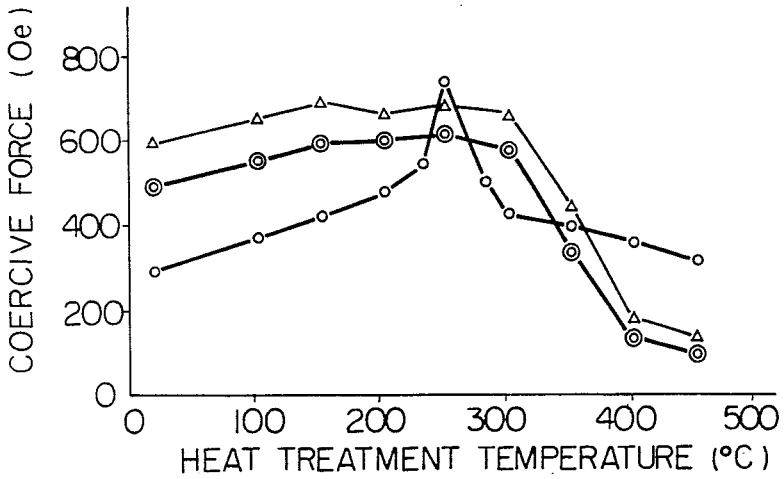
FIG. 6 is a graph representing the dependence of the coercive force upon the heat treatment temperature in air.

The relationship between the coercive force and the heat treatment temperature is illustrated in FIG. 6, wherein the curves —Δ—, —⊙— and —o— indicate the iron oxides containing 10% of each of both Nb and Cu, 5% of each of both Nb and Cu, and no Nb and Cu, respectively. As is clear from FIG. 6, the iron oxide containing neither Cu nor Nb (—o—) has a maximum peak value of coercive force in a considerably narrow temperature range. It is, therefore, extremely difficult to adjust the oxidation temperature in this narrow range. Contrary to this, the $\gamma$-$Fe_2O_3$ films produced by the oxidation and containing Nb and Cu (—Δ—, —⊙—) have an almost constant coercive force over a temperature range from 200° to 300° C.

Figure 7:
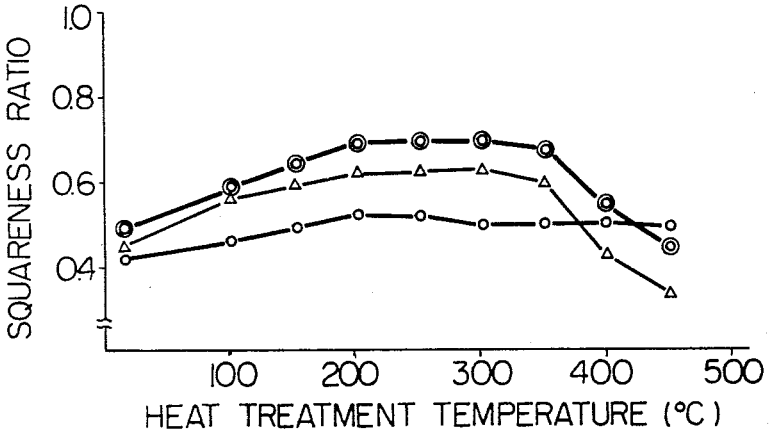
FIG. 7 is a graph representing the dependence of the squareness ratio upon the heat treatment temperature in air.

The relationship between the squareness ratio and the heat treatment temperature is illustrated in FIG. 7. As is clear from this figure, the squareness ratio of the $\gamma$-$Fe_2O_3$ containing Nb and Cu are higher than the $\gamma$-$Fe_2O_3$ containing no Nb and Cu over almost all temperatures, and are almost constant at temperatures from 200° to 300° C.

As is understood from the explanations given in regard to FIGS. 6 and 7, the magnetic properties of $\gamma$-$Fe_2O_3$ films containing both Nb and Cu are very stable.

$\gamma$-$Fe_2O_3$ films containing Nb and Cu in a total amount of up to twenty five percent, the molar ratio of Nb and Cu being equal, were produced by oxidation in air at 300° C. The substrate, on which the $\gamma$-$Fe_2O_3$ films were formed, was made of glass.

Figure 8:
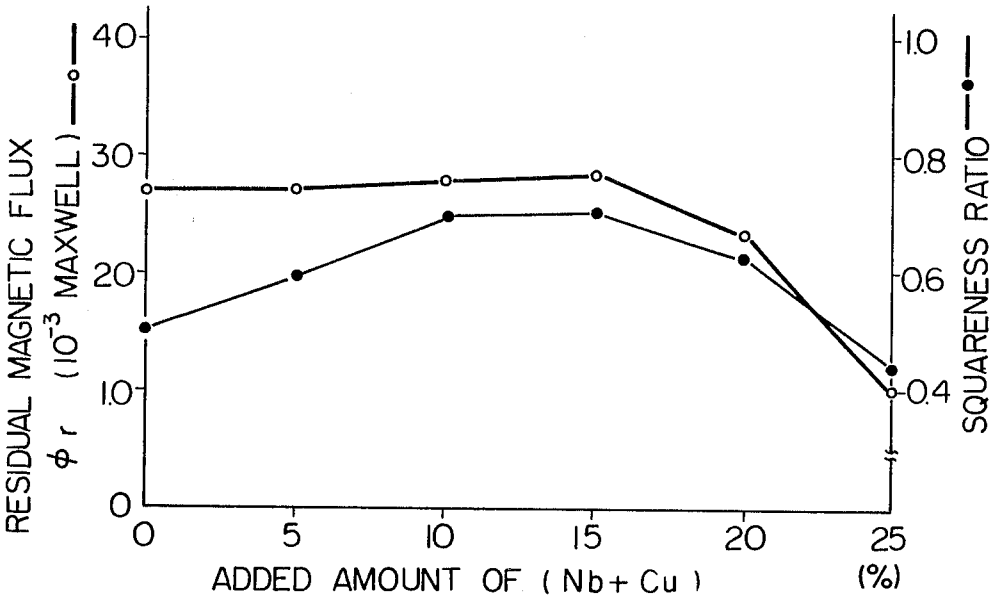
FIG. 8 is a graph representing the dependence of both the residual magnetic flux and the squareness ratio upon the amount of Nb and Cu, which are added in equal molar amount.

The relationships between the residual magnetic flux and the added total amount of Nb and Cu, as well as between the squareness ratio and the total amount, are illustrated in FIG. 8. As is clear from this figure, excellent residual magnetic flux and squareness ratio can be obtained at the total amount from 2 to 18%, i.e. from 1 to 9% of each of Nb and Cu, particularly from 10 to 15% in total amount.

Hereinafter, the present invention will be illustrated in more detail with reference to specific examples; however, these examples are not to be constructed as examples which limit the scope of the invention.

EXAMPLE 1

The sputtering was performed by using an Fe target containing five percent of Nb under the conditions of a mixed-gas atmosphere of 80% of Ar and 20% of $O_2$, with the pressure of the atmosphere in the sputtering device being $10^{-6}$ torr. An $\alpha$-$Fe_2O_3$ film containing five percent of Nb was formed on a glass substrate up to a thickness of 0.15 microns, as a result of the sputtering. This $\alpha$-$Fe_2O_3$ was reduced in an $H_2$ atmosphere at a temperature of 330° C. over a period of one hour, thereby obtaining $Fe_3O_4$, which also contained five percent of Nb. The $H_2$ gas was wet due to being bubbled through water. By measuring the electric resistance of the thin film, formation of $Fe_3O_4$ was confirmed.

The coercive force and the squareness ratio of the thus formed $Fe_3O_4$ were 530 Oe and 0.7, respectively.

EXAMPLE 2

The procedure of Example 1 was repeated except that the Fe-target containing ten percent of Nb was used. As a result, an $Fe_3O_4$ film containing seven percent of Nb was produced. The coercive force and the squareness ratio of the thus produced $Fe_3O_4$ were 700 Oe and 0.8, respectively.

EXAMPLE 3

The procedure of Example 1 was repeated except that the atmosphere of sputtering contained 2, 5, 10 and 20% of oxygen. The coercive force and the squareness ratio of the produced $Fe_3O_4$ varied only due to experimental errors between 500 and 530 Oe, and between 0.7 and 0.8, respectively. These magnetic properties are, therefore, not dependent on the sputtering condition.

EXAMPLE 4

The procedure of Example 1 was repeated except that the substrate was an aluminum plate, on which an anodic oxidation layer was formed to a thickness of three microns. A thin film of ferrite was formed on the oxidation layer. The coercive force and the squareness ratio of the thin film of $Fe_3O_4$ containing Nb were 500 Oe and 0.6, respectively.

EXAMPLE 5

The thin $Fe_3O_4$ films produced in Example 4 were subjected to a heat treatment in an air atmosphere at a temperatue of 200° C. over a period of one hour. As a result of the heat treatment, $\gamma$-$Fe_2O_3$ was formed. The formation of $\gamma$-$Fe_2O_3$ was confirmed by measuring the electrical resistance of the thin films. An improvement was noted in the values for the coercive force and the squareness ratio of the $\gamma$-$Fe_2O_3$ which were 500 Oe and 0.8, respectively.

EXAMPLE 6

The thin films produced in Example 5 were tested with regard to their properties of adhesion and strength. In order to test these properties, a disc which carried the thin film was rotated relative to a magnetic head at a relative rate of 7 m/sec. The magnetic head was forced to come into contact with the thin film, and, subsequently, the head was floated above the film. The property of adhesion between the film and the substrate and the property of the film strength were found to be very much improved due to the addition of Nb into the iron oxides. The resistance of the thin film during collision of the magnetic head against the films was also shown to be very much improved by the addition of Nb.

EXAMPLE 7

The recording properties of the magnetic disc were measured using a magnetic head with a core of NiZn ferrite. The core had a gap portion with a length of 0.67 microns; the core had a width of 530 microns. The magnetic head was floated above the disc at a distance of 0.25 microns. The relative speed of the head with respect to the disc was seven meters per second.

The recording density of the magnetic disc was 650 bits per mm.

EXAMPLE 8

The sputtering was performed by using an Fe target containing five percent of Nb and five percent of Cu under the conditions of a mixed-gas atmosphere of 80% of Ar and 20% of $O_2$. An $\alpha$-$Fe_2O_3$ film containing five percent of Nb and five percent of Cu was formed on a glass substrate up to a thickness of 0.12 microns, as a result of the sputtering. This $\alpha$-$Fe_2O_3$ was reduced in an $H_2$ atmosphere at a temperature of 250° C. over a period of one hour, thereby obtaining $Fe_3O_4$, which also contained five percent of Nb and five percent of Cu. The $H_2$ gas was wet due to being bubbled through water. The $Fe_3O_4$ was heat treated in air at 300° C. to produce $\gamma$-$Fe_2O_3$. The coercive force and the squareness ratio of the thus formed $\gamma$-$Fe_2O_3$ were 580 Oe and 0.7, respectively.

EXAMPLE 9

The procedure of Example 8 was repeated except that the Fe target contained 10% of Nb and 10% of Cu. The coercive force and the squareness ratio of the produced $\gamma$-$Fe_2O_3$ were 660 Oe and 0.63 respectively.

EXAMPLE 10

The procedure of Example 1 was repeated except that the substrate consisted of an aluminum plate, on which an anodic oxidation layer was formed to a thickness of three microns, and further, the sputtering atmosphere consisted of 50% of $O_2$ and 50% of Ar. A film of $\alpha$-$Fe_2O_3$ was formed to a thickness of 0.12 micron on the Al substrate. The film of $\alpha$-$Fe_2O_3$ was reduced at 330° C. over a period of one hour in the $H_2$ atmosphere, thereby obtaining $Fe_3O_4$. The coercive force and the squareness ratio of the thin film of $Fe_3O_4$ containing Nb were 580 Oe and 0.75, respectively.

EXAMPLE 11

The procedure of Example 9 was repeated except that the Fe target contained five percent of Nb and five percent of Cu, the reduction temperature was 250° C., and heat treatment temperature for forming the $\gamma$-$Fe_2O_3$ was 300° C. The coercive force and the squareness ratio of the produced $\gamma$-$Fe_2O_3$ were 300 Oe and 0.5, respectively.

What we claim is:

1. A process for producing a magnetic recording medium of a thin film of ferrite, said process comprising the steps of:

forming a thin film of $\alpha$-$Fe_2O_3$, wherein said $\alpha$-$Fe_2O_3$ film comprises niobium in an amount from 0.1 to 10 percent based on the total number of the metallic atoms in said ferrite film;

reducing said thin film of $\alpha$-$Fe_2O_3$ to $Fe_3O_4$ by heating said $\alpha$-$Fe_2O_3$ containing said niobium at a temperature of from 325° to 400° C. under an atmosphere containing a hydrogen gas; and, oxidizing said $Fe_3O_4$ to $\gamma$-$Fe_2O_3$ by heating said $Fe_3O_4$ containing niobium at a temperature from 150° to 450° C. in an atmosphere which contains oxygen.

2. The process of claim 1 comprising forming said $\gamma$-$Fe_2O_3$ to have coercive force in the range from 500 to 570 Oe.

3. The process of claim 1 comprising forming said $\gamma$-$Fe_2O_3$ to have squareness ratio in the range 0.5 to 0.9.

4. A process for producing a magnetic recording medium of a thin film of ferrite, said process comprising the steps of:

forming a thin film of $\alpha$-$Fe_2O_3$ comprising a component of niobium in an amount from one to ten percent and copper in an amount from one to fifteen percent based on the total number of the metallic atoms in said ferrite film;

reducing said thin film of $\alpha$-$Fe_2O_3$ to $Fe_3O_4$ by heating said $\alpha$-$Fe_2O_3$ containing said niobium and copper at a temperature of from 225° to 400° C. under an atmosphere containing a hydrogen gas; and, oxidizing said $Fe_3O_4$ to $\gamma$-$Fe_2O_3$ by heating said $Fe_3O_4$ containing said niobium and copper at a temperature from 150° to 450° C. in an atmosphere which contains oxygen.

5. A process according to claim 4, wherein the reduction temperature is from 225° to approximately 300° C.

6. The methods of claims 1 or 4 comprising forming said $\gamma$-$Fe_2O_3$ film to have a thickness between 0.05 to 1 micron.

7. The methods of claims 1 or 4 comprising forming said $\gamma$-$Fe_2O_3$ films to have a thickness between 0.05 to 0.4 microns.

8. The process of claim 4 comprising reducing said film of $\alpha$-$Fe_2O_3$ to $Fe_3O_4$ at a temperature in the range from 200° to 300° C. to cause said film to have a coercive force in the range from 500 to 700 Oe which is essentially independent of said reduction temperature.

9. The process of claim 4 comprising oxidizing said $Fe_3O_4$ at a temperature in the range from 100° to 400° C. to result in said $\gamma$-$Fe_2O_3$ film having a squareness ratio in the range from 0.5 to 0.7.

10. The process of claim 9 comprising oxidizing said $Fe_3O_4$ at a temperature in the range from 200° to 300° C. to result in said squareness ratio being essentially independent of said oxidation temperature.

11. The process of claim 4, each of said niobium and copper being added in amount from 1 to 9%.

12. The process of claim 4, said copper and niobium being added in approximately equal amounts and the total amount of said copper and niobium being between 2 and 18%, said film of $\gamma$-$Fe_2O_3$ having residual magnetic flux between $20\times10^{-3}$ and $27\times10^{-3}$ maxwell.

13. The process of claim 1 comprising reducing said film of $\alpha$-$Fe_2O_3$ at a temperature in the range from 325° to 375° C.

* * * * *

UNITED STATES PATENT AND TRADEMARK OFFICE

CERTIFICATE OF CORRECTION

PATENT NO. : 4,215,158

DATED : July 29, 1980

INVENTOR(S) : SEIZI HATTORI ET AL

It is certified that error appears in the above—identified patent and that said Letters Patent is hereby corrected as shown below:

Col. 1, line 24, after "of" delete "the".

Col. 2, line 5, "300°C.," should be --300°C,--;

Col. 2, line 23, after "$Fe_3O_4$" insert --,--;

Col. 2, line 30, "up to ten atomic" should be --of between 0.1 and 10--;

Col. 2, line 44, "to" should be --and--;

Col. 2, line 49, after "atoms" delete ",";

Col. 2, line 50, after "atoms" delete ",".

Col. 3, lines 4, 15 (both occurrences), 24 and 36, after "C" delete ".";

Col. 3, line 26, "the distortion and cracking of" should be --distortion and cracking of the--;

Col. 3, line 61, after "and" insert --,--.

Col. 4, line 17, "the" should be --and--;

Col. 4, line 27, after "C" delete ",";

Col. 4, line 51, after "indicate" delete ",".

UNITED STATES PATENT AND TRADEMARK OFFICE

CERTIFICATE OF CORRECTION

PATENT NO. : 4,215,158

DATED : July 29, 1980

INVENTOR(S) : SEIZI HATTORI ET AL

It is certified that error appears in the above—identified patent and that said Letters Patent is hereby corrected as shown below:

Col. 5, line 10, after "range" insert --of--;

Col. 5, line 18, after "C" delete ".".

Col. 6, line 13, "condition" should be --conditions--;

Col. 6, line 14, after "C" delete ".".

Col. 7, line 26, after "C" delete ".".

Col. 8, lines 41, 44 and 65, after "C" delete ".".

Col. 9, lines 5, 21 and 25, after "C" delete ".".

Col. 10, lines 3, 7, 19, 23 and 27, after "C" delete ".".

Signed and Sealed this

*Sixth* Day of *January 1981*

[SEAL]

*Attest:*

SIDNEY A. DIAMOND

*Attesting Officer*

*Commissioner of Patents and Trademarks*